US005156202A

United States Patent [19]

Sick et al.

[11] Patent Number: 5,156,202

[45] Date of Patent: Oct. 20, 1992

[54] PROCESS AND PERMANENT MOLD FOR MOLD-CASTING ELECTRICALLY CONDUCTIVE MATERIAL

[75] Inventors: Georg Sick, Freigericht; Otto W. Stenzel, Gruendau, both of Fed. Rep. of Germany

[73] Assignee: Leybold Aktiengesellschaft, Hanau, Fed. Rep. of Germany

[21] Appl. No.: 754,324

[22] Filed: Sep. 4, 1991

Related U.S. Application Data

[63] Continuation of Ser. No. 423,796, Oct. 18, 1989, abandoned.

[30] Foreign Application Priority Data

Jul. 15, 1989 [DE] Fed. Rep. of Germany ..... 3923550

[51] Int. Cl.[5] ..... B22D 15/00; B22D 18/02; B22D 23/06

[52] U.S. Cl. ..... 164/493; 164/80; 164/120; 164/513

[58] Field of Search ..... 164/80, 493, 513, 120, 164/503, 502, 467, 466

[56] References Cited

U.S. PATENT DOCUMENTS

| | | | |
|---|---|---|---|
| 2,686,864 | 8/1954 | Wroughton et al. . | |
| 2,758,188 | 8/1956 | Okress . | |
| 3,460,608 | 8/1969 | Grechin et al. | 164/513 |
| 3,945,428 | 3/1976 | Yanagisawa et al. | 164/319 |
| 4,572,812 | 2/1986 | Ciszek | 164/503 X |

FOREIGN PATENT DOCUMENTS

| | | | |
|---|---|---|---|
| 0275228 | 7/1988 | European Pat. Off. | 164/502 |
| 0276544 | 8/1988 | European Pat. Off. . | |
| 234979 | 4/1910 | Fed. Rep. of Germany . | |
| 599323 | 6/1934 | Fed. Rep. of Germany . | |
| 676664 | 6/1939 | Fed. Rep. of Germany . | |
| 1147714 | 4/1963 | Fed. Rep. of Germany . | |
| 1558202 | 3/1970 | Fed. Rep. of Germany . | |
| 2100378 | 7/1971 | Fed. Rep. of Germany . | |
| 2353449 | 1/1975 | Fed. Rep. of Germany . | |
| 151121 | 10/1981 | German Democratic Rep. . | |
| 264420 | 8/1981 | U.S.S.R. | 164/513 |

*Primary Examiner*—J. Reed Batten, Jr.
*Attorney, Agent, or Firm*—Felfe & Lynch

[57] ABSTRACT

A permanent mold for mold-casting reactive metals and metal alloys (FIG. 1) includes a multiple of radially disposed, plate-like segments 3, 3', 3'', . . . which enclose the workpiece 12 and are preferably made of cooled metallic material and which form together the permanent mold including a top inlet opening 14 and a bottom opening 15 for withdrawing the working piece; in order to close the withdrawal opening 15, a closing plate 9 is provided which is composed of a multiple of ring segments 13, 13', 13'', . . . and the permanent mold 5 is enclosed by a magnetic coil 6 so as to generate an electromagnetic field. A pressure element 10 can be introduced into the inlet opening 14 of the permanent mold 5 and the diameter thereof corresponds to the one of the inlet opening 14 and it can be moved in vertical direction A and a second pressure element 11 is provided which is vertically guided in the closing plate 9 where it can be moved in an upward direction such that during solidification, pressure can be applied to the workpiece which is enclosed by the permanent mold thus permitting a compression.

5 Claims, 2 Drawing Sheets

PROCESS AND PERMANENT MOLD FOR MOLD-CASTING ELECTRICALLY CONDUCTIVE MATERIAL

Figure 1:
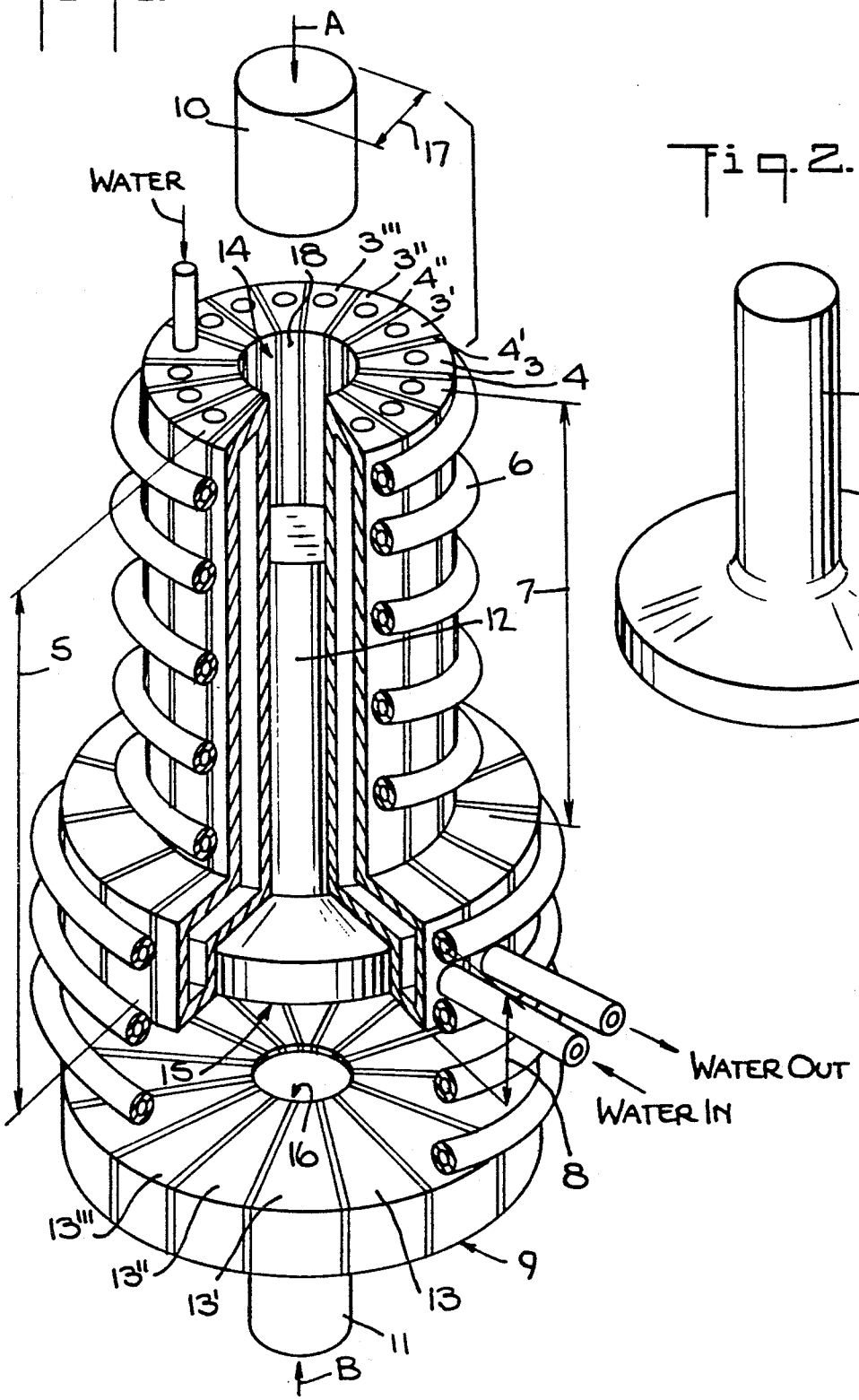

This application is a continuation of application Ser. No. 423,796, filed Oct. 18, 1989 and now abandoned.

The invention relates to a process and a permanent mold for moldcasting electrically conductive materials, particularly for casting reactive metals and metal alloys.

It is known (U.S. Pat. No. 2,686,864; U.S. Pat. No. 2,758,188; German patent 1 14 77 14) to melt electrically conductive materials in a crucible which is enclosed by a magnetic coil with a high frequency electromagnetic field which keeps the melt in a suspended state, i.e. prevents a contact between melt and crucible wall during the melting process. An advantage of this melting process is the possibility of melt reactive metals while avoiding corrosion of the internal wall of the crucible.

Also known is an inductively heatable melting crucible (DAS 2 100 378; European patent 0 276 544) including radially disposed, platelike segments which enclose a crucible like hollow space and are supported at bottom ends by a common base; below the hollow space, these segments slightly project toward the interior. The platelike segments and the base thereof are made of an electrically well conductive material and the segments which freely extend from the base in an upward direction are separated from one another by means of an air gap.

Generally known is investment casting making use of ceramic as well as of metal molds. It is the object of this investment casting to achieve a good mold filling, a low porosity in the cast piece caused by gas voids or shrinkage during solidification and an advantageous solidifying structure.

For many parts manufactured by means of investment casting, these requirements can be met by using ceramic molds. The disadvantage of the ceramic mold is the expensive manufacture thereof and the fact that ceramic molds are usually not designed for reuse. Investment casting with broken molds is therefore not suitable for inexpensive mass production.

As an alternative to this, there are metal molds (permanent molds) which are designed for reuse and made either of metal or graphite, for example. The use of cold metallic molds is restricted, however, to a few processes and metals since the filling of cold, metallic molds is difficult and since the metal rapidly solidifies when contacting the mold wall such that thin cross sections are often not completely filled.

This fact calls for an advantageous filling of the metallic molds with metal at a high speed. This method is usually employed for diecasting. In this process, the metal is pressed into the permanent mold while employing pressure. In order to prevent hollow spaces form developing which is caused by shrinkage, the solidified casting is in many cases subject to postcompression. Also, processes are known wherein the metallic melt is sucked in the casting chamber by means of an immersion tube and by applying a vacuum.

Finally, it was also suggested to partially or completely heat up the mold before introducing the melt so as to optimize the filling of the mold and avoid an interfering, premature solidification of the metal in critical areas of the mold. Preheating of the mold, however, is only possible to a certain extent since it is the object to achieve a solidification in the mold, to select a certain solidification speed so has to have a certain solidifying structure and to avoid a reaction between melt and mold material.

A particular challenge is the casting of reactive metals and alloys, particularly in intermetallic phases (Ti, W, Ta, Nb, superalloys) since reactions between the mold material and the melt are particularly strong in this case.

It is hence an object of the invention to develop a permanent mold which does not react even with reactive melts, permits rapid cooling and, at the same time, a good filling of the mold.

The object is accomplished in accordance with the invention in that the mold is composed of a multiple of metal segments and, depending on the configuration, the interspaces between the segments are filled with nonconductive material or they are open gaps permitting an electromagnetic field to act upon the melt in the mold or upon the casting; the object is further accomplished by means of a device which presses the melt to the inside profile of the mold by applying pressure and which performs a postcompression during solidification.

The claims characterize further details and features of the invention.

The invention permits the most various embodiments, two of which are diagrammatically represented in further detail in the attached drawing. Referring now to the Figs.

Figure 2:
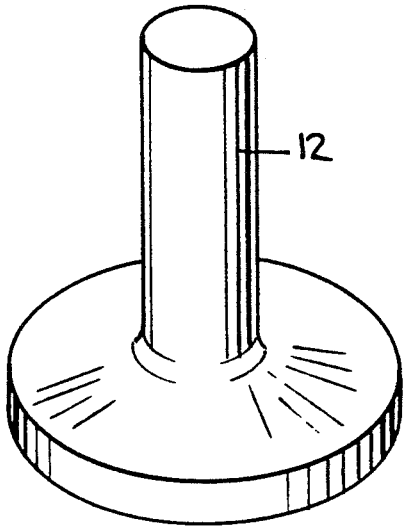
Figure 3:
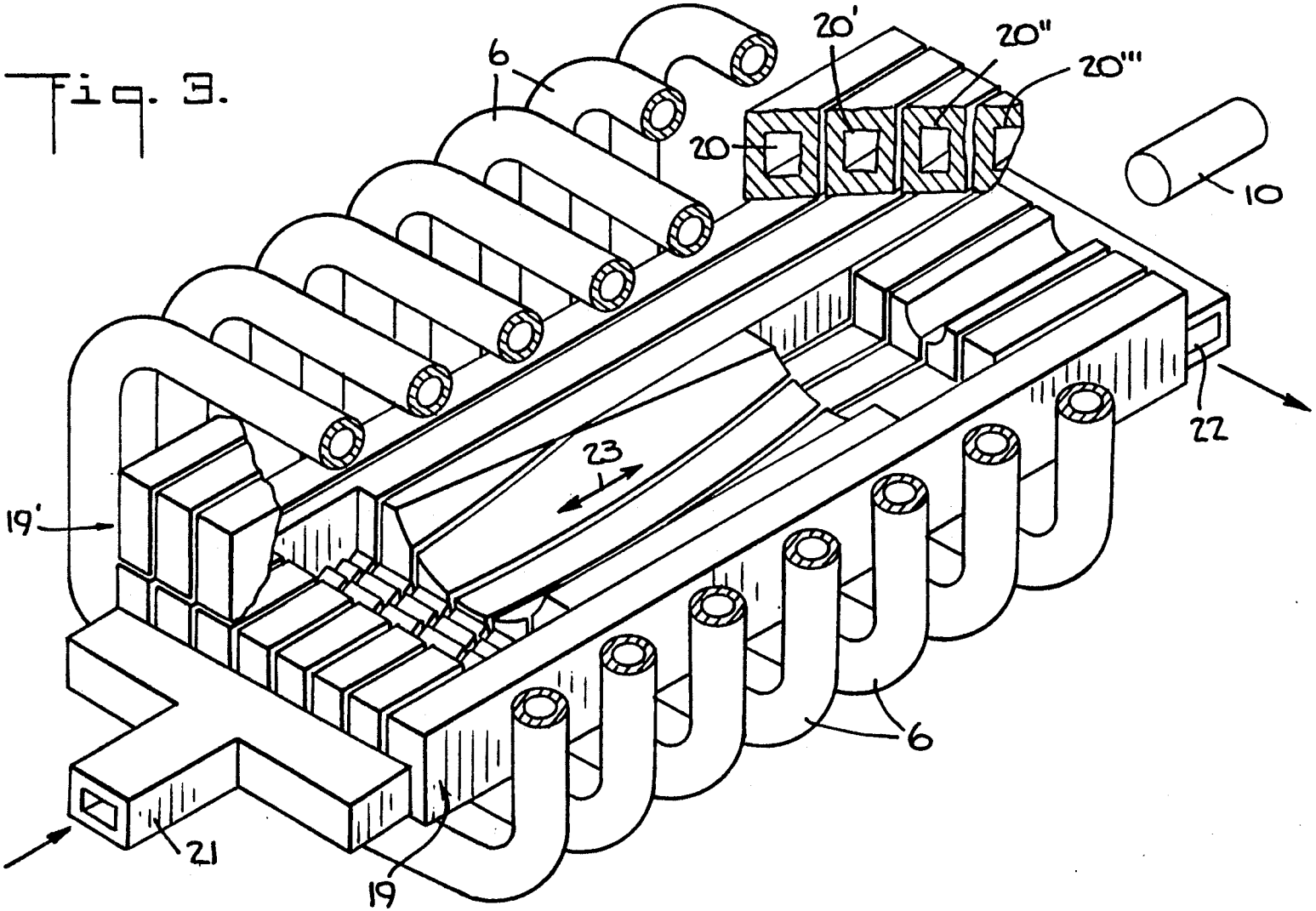

FIG. 1 is a partial longitudinal section of an exploded view of a dynamically balanced permanent mold, together with the circular closing plate and two pressure elements, FIG. 2 is a perspective view of a casting and FIG. 3 is an exploded view of a two-shell permanent mold for a work piece which is not dynamically balanced (turbine blade) partially representing the one half-shell and the induction coil.

The permanent mold as illustrated in FIG. 1 for casting a valve from titanium or a titanium alloy for a combustion engine includes a multiple of individual L-shaped segments 3, 3', . . . of the same configuration which are stave-like joined to one another so as to form an approximately flange-like hollow body 5 and which are provided with a chamber passed through by a cooling agent and an insulating mass . . . can be inserted into the gap 4, 4', . . . formed by the segments 3, 3', . . . The flange-like hollow body or permanent mold 5 is enclosed by an induction coil 6, the upper windings of which are smaller in diameter in the upper portion 7 of the hollow body than in the area of the lower portion 8 which forms the flange. The unloading opening 15 of the hollow body 5 which is provided at the bottom of the lower portion 8 can be closed by means of a discoidal plate 9. For this purpose said plate 9 can be pressed in direction A against the bottom of the hollow body 5 by means of a corresponding device; this is not represented in further detail. The plate 9 itself includes a certain number of ring segments 13, 13', . . . which are joined together, as is the hollow body 5, by means of small rings (not represented in further detail) which enclose the bodies 5 and 9; instead of rings, it is also possible to provide a riveted or screwed connection. The connections of the cooling agent are also not shown. The permanent mold of the drawing is suited for casting valves 12 from titanium for combustion engines; the casting process is carried out as follows:

A liquid material (melt) or a solid material is charged into the top opening 14 formed by the hollow body 5 in an exactly metered amount; the lower unloading opening 15 is closed by means of the closing plate 9 and the pressure element 11. When a medium or high frequency voltage is applied to the induction coil 6, the charged material is inductively melted or remains in a liquid or pasty state. The electromagnetic forces press the liquid metal at many points away from the inside wall 18 of the permanent mold 5. Subsequently, either one or both of the pressure elements 10 and 11 act or move so as to apply pressure onto the charged melt or the casting 12 in direction A or B; the outer surfaces 17 of the pressing elements 10 (and 11) act as pistons in the cylindrical bore shaped by the inner side wall 18 and the central opening 16 in the closing plate 9, respectively; the casting 12 is thus pressed against the inside profile 18 of the permanent mold 5 and compressed while the material of the casting 12 is simultaneously solidified under the effect of at least one of gravity and centrifugal forces and a compressor piston due to the great heat sink in contact with the permanent mold 5.

Subsequently, the mold can be opened by removing the closing plate 9 and the pressure element 11 such that the cast part 12—in this case the valve from a titanium alloy as represented in FIG. 2—can be withdrawn from the mold 5.

In order to trigger solidification and shaping of the melt, the pressure elements 10, 11 act upon the melt as described above. The melt is thus pressed against the inside wall 18 of the mold 5 and, first, the melt solidifies in the marginal areas due to the great heat sink (of the either cooled or capacitively acting uncooled mold); the inductive heating coil 6 can subsequently be turned off or remain turned on while being advantageously controlled for additional energy supply. This also permits a material feeding and a shrinkage compensation. A refeed and a compensation of the casting 12 are also possible by further applying pressure via pressure elements 10, 11.

The device as described offers the possibility of heating up a melt in a permanent mold while simultaneously avoiding undesired reactions between the inside wall 18 of the permanent mold 5 and the melt. The process as described is hence particularly suited for the casting of reactive metals.

The individual segments 3, 3', . . . and 13, 13', . . . are provided with chambers which are connected to a circulatory cooling system; this is not represented in the drawing in further detail. This ensures that there are no reactions triggered between the melt and the inside wall 18 of the mold 5. Moreover, this also ensures a rapid cooling of the casting 12.

In the embodiment according to FIG. 3, the permanent mold (for casting a turbine blade) includes two half-shells which in turn include a multiple of segments; the individual segments have chambers 20, 20', . . . which are passed through by a cooling agent entering the chambers 20, 20', . . . via the t-shaped distributing pipe 21 and emerging at 22. After completion of the casting, the two half-shells 19, 19',, can be displaced with respect to each other such that the casting can be removed from the chamber 23.

The permanent mold including segments is disposed in a process chamber of a vacuum device and the mold-casting is carried out in a protective atmosphere.

We claim:

1. An apparatus for casting at least one of a reactive metal and alloy as a reactive material comprising:

a multiplicity of cooled segments of non-uniform shape and made of an electrically conductive material and are separated from one another by gaps and form together a permanent mold of non-uniform cross-sectional shape, and an induction coil enclosing the permanent mold for generating an electromagnetic field at a part which is formed by the segments for at least one of melting the reactive material and maintaining the reactive material in a liquid state, a closing plate at a bottom of the permanent mold and including segments;

a first pressure member guided in a central opening which is formed by the segments of the closing plate which come upon the reactive material in a vertical direction to solidify the reactive material in contact with the cooled segments.

2. The apparatus in accordance with claim 1, which comprises a second pressure member introduced into an opening of an inlet of the permanent mold, said inlet being formed by said multiplicity of segments of said mold, and said second pressure member having a diameter which corresponds to the diameter of the inlet opening and said second pressure member acting upon the reactive material in a vertical direction.

3. The apparatus in accordance with claim 1, in which the cooled segments enclose the reactive material and have chambers through which a cooling agent at least partially passes.

4. A method for casting reactive material to form a casting of non-uniform cross-sectional shape in an apparatus for casting at least one of a reactive metal and alloy as a reactive material comprising a multiplicity of cooled segments of non-uniform shape and made of an electrically conductive material and separated from one another by gaps and form a permanent mold of non-uniform cross-sectional shape, and an induction coil enclosing the permanent mold for generating an electromagnetic field at a part which is formed by the segments for at least one of melting the reactive material and maintaining the reactive material in a liquid state, a closing plate at a bottom of the permanent mold and including segments, a pressure member guided in a central opening which is formed by the segments of the closing plate which come upon the reactive material in a vertical direction to solidify the reactive material in contact with the cooled segments, the method comprising:

introducing at least one of a reactive metal and metal alloy as a material into the permanent mold having segments of non-uniform shape;

then, generating an electromagnetic alternating field by the coil surrounding the permanent mold for melting the material and maintaining the material in a liquid state therein;

under the effect of the pressure member pressing the material against an internal wall of the permanent mold where it solidifies in contact with the cooled wall segments to form a casting of non-uniform cross-sectional shape; and during solidification of the material, after the forming of a marginal shell, carrying out a compression by means of a piston at a portion of the casting where there is still a remainder of the material in the liquid state so as to avoid the formation of a shrinkage cavity.

5. Method in accordance with claim 4, which comprises disposing the apparatus including segments in a process chamber of a vacuum device and carrying out the method of claim 4 in a protective atmosphere.

* * * * *